US005485258A

United States Patent [19]

Montfort

[11] Patent Number: 5,485,258

[45] Date of Patent: Jan. 16, 1996

[54] VACUUM COUPLING ARRANGEMENT FOR APPLYING VIBRATORY MOTION TO A FLEXIBLE PLANAR MEMBER

[75] Inventor: David B. Montfort, Penfield, N.Y.

[73] Assignee: Xerox Corporation, Stamford, Conn.

[21] Appl. No.: 369,442

[22] Filed: Jan. 6, 1995

[51] Int. Cl.[6] ..... G03G 15/16

[52] U.S. Cl. ..... 355/273; 355/271

[58] Field of Search ..... 355/273, 271, 355/274, 200, 212; 430/126

[56] References Cited

U.S. PATENT DOCUMENTS

| | | | |
|---|---|---|---|
| 2,836,725 | 5/1958 | Vyverberg | 250/49.5 |
| 4,947,214 | 8/1990 | Baxendell et al. | 355/274 |
| 4,987,456 | 1/1991 | Snelling | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski | 355/273 |
| 5,025,291 | 6/1991 | Nowak et al. | 355/273 |
| 5,081,500 | 1/1992 | Snelling | 355/273 |
| 5,210,577 | 5/1993 | Nowak et al. | 355/273 |
| 5,282,005 | 1/1994 | Nowak et al. | 355/273 |
| 5,282,006 | 1/1994 | Fletcher | 355/273 |
| 5,327,324 | 7/1994 | Roth | 361/707 |
| 5,329,341 | 7/1994 | Nowak et al. | 355/273 |
| 5,357,324 | 10/1994 | Montfort | 355/273 |

*Primary Examiner*—R. L. Moses
*Attorney, Agent, or Firm*—Denis A. Robitaille

[57] ABSTRACT

An apparatus for enhancing transfer of a developed toner image from an image bearing member to a support substrate in an electrostatographic printing machine including a resonator suitable for generating vibratory energy arranged in line contact with the back side of the image bearing member for uniformly applying vibratory energy to the image bearing member. The toner release enhancing system includes a vacuum source, including a vacuum plenum substantially enclosing the resonator and defining an opening adjacent the image bearing member, wherein the vacuum source provides sufficient force at the vacuum plenum opening to draw the image bearing member toward the resonator, and an integral air regulator system for providing substantially constant air pressure at the interface between the resonator and the image bearing member.

23 Claims, 3 Drawing Sheets

VACUUM COUPLING ARRANGEMENT FOR APPLYING VIBRATORY MOTION TO A FLEXIBLE PLANAR MEMBER

The present invention relates generally to a system for applying vibratory energy to an imaging surface for enhanced toner transfer in an electrostatographic printing machine, and more particularly concerns a vacuum coupling arrangement including an air regulating device for use in conjunction with a system for applying vibratory motion to an image bearing member in an electrostatographic printing machine.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge on the photoconductive surface in image areas, thereby creating an electrostatic latent image of the original document on the photoreceptive member. Charged developing material is subsequently deposited onto the photoreceptive member such that the toner particles are attracted to the charged image areas to develop the electrostatic latent image into a visible image. This developed image is then transferred from the photoreceptive member, either directly or after an intermediate transfer step, to a copy sheet or other support substrate to create an image on the copy sheet corresponding to the original document. The transferred image may then be permanently affixed to the copy sheet through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction where charge is deposited on a charge retentive surface in response to electronically generated or stored images.

Typically, the process of transferring charged toner particles from an image bearing support surface, such as a photoreceptor, to a second support surface, such as a copy sheet or an intermediate transfer belt, is enabled by overcoming adhesion forces holding toner particles to the image bearing surface. In a conventional electrostatographic printing machine, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. The corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Thus, the process of transferring development materials in an electrostatographic system involves the physical detachment and transfer-over of charged toner particles from an image bearing surface into attachment with a second surface via electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required to induce the physical detachment and transfer-over of the charged toner particles without scattering or smearing of the developer material. Unfortunately, the interface between the image bearing surface and the second support surface is not always optimal. In particular, situations arise in which a copy sheet is not perfectly planar, such as the case in which copy sheets that have already passed through a fixing operation (e.g., heat and/or pressure fusing), perforated sheets, or sheets that are cockled or wrinkled for some reason or another, resulting in non-uniform contact between the sheet and the image bearing surface, creating gaps which prevent contact with the image bearing surface. There is a tendency for toner not to transfer across these gaps, causing a copy quality defect referred to as transfer deletion.

The problems associated with transfer deletions have been addressed by various means. For example, mechanical devices that force the second support surface into intimate and complete contact with the image bearing surface have been incorporated into transfer systems. For example, U.S. Pat. No. 4,947,214 to Baxendell et al. discloses the use of a blade arrangement which presses against the back side of the second support surface at the entrance to the transfer region as a device for enhancing contact between the copy sheet and the photoreceptor. Alternatively, the use of vibratory energy has been disclosed, for example in U.S. Pat. No. 3,854,974 to Sato, et al., as a method for enhancing toner release from the image bearing surface. More recently, systems which incorporate a resonator suitable for generating focused vibratory energy, arranged along the back side of the image bearing surface for applying uniform vibratory energy thereto, have been disclosed, whereby toner is released from the image bearing surface despite the fact that electrostatic charges in the transfer zone may be insufficient to attract toner from the image bearing surface to the second support surface (see U.S. Pat. No. 5,081,500 to Snelling, for example). Various arrangements for coupling a resonator to an image bearing surface such that vibratory motion can be applied thereto have been proposed, as for example in U.S. Pat. Nos. 4,987,456 to Snelling, et al., and 5,357,324 to Montfort, the contents of which are completely incorporated by reference herein.

As disclosed in U.S. Pat. No. 4,987,456, a resonator suitable for generating focused vibratory energy generally includes a contacting tip which is brought into tension or penetration contact with the image bearing belt for coupling the vibratory motion located by the resonator to the belt. Thus, proper coupling is necessary between the photoreceptor belt and the resonator tip for transmitting identical sinusoidal motion from the tip to the toner residing on the belt. The present invention is directed toward a vacuum plenum design incorporating an integral air pressure regulating device for coupling vibratory energy from a resonator tip to a belt.

U.S. Pat. No. 5,327,324 to Montfort discloses an apparatus for enhancing transfer of a developed toner image from an image bearing member to a support substrate in an electrostatographic printing machine. The transfer enhancing system includes a resonator for applying vibratory energy to the image bearing member to facilitate toner release therefrom, a vacuum source, including a vacuum plenum substantially enclosing the resonator and defining an opening adjacent the image bearing member, wherein the vacuum source provides sufficient force at the vacuum plenum opening to draw the image bearing member toward the resonator, and a replaceable coupling cover for mounting on the vacuum plenum, in alignment with the opening defined thereby, to couple the resonator to the image bearing member.

In accordance with one aspect of the present invention, there is provided a system for enhancing transfer of toner from an image bearing member, comprising: means for applying vibratory energy to the image bearing member to facilitate toner release therefrom; vacuum means for generating negative air pressure to draw the image bearing member toward the vibratory energy applying means; and air flow regulating means for regulating the negative air pressure at an interface between the vibratory energy applying means and the image bearing member. The air flow regulating means includes: a vacuum regulator port defining an inlet bore for allowing air to flow into a vacuum plenum; a spring member for being inserted into the inlet bore; a ball bearing member for being further inserted into the inlet bore adjacent the spring member; and a hollow adjustment screw for being threaded into the vacuum regulator port so as to compress the spring member by pressing the ball bearing member thereagainst.

In accordance with another aspect of the present invention, an electrostatographic printing machine of the type in which a developed toner image is transferred from an image bearing member to a support substrate via a transfer system is provided, including a system for enhancing release of toner from the image bearing member. The toner release enhancing system includes a resonator for applying vibratory energy to the image bearing member to facilitate toner release therefrom, a vacuum apparatus for urging the image bearing member toward the coupling cover; and an air flow regulator coupled to the vacuum apparatus for regulating air pressure at an interface between the resonator and the image bearing member.

In accordance with yet another aspect of the present invention, an apparatus for applying vibratory motion to a flexible planar member is provided, comprising: resonator means for applying vibratory energy to the flexible planar member; vacuum means, including a vacuum plenum substantially enclosing the resonator means and defining an opening adjacent the flexible planar member, wherein the vacuum means provides sufficient force at the vacuum plenum opening to draw the flexible planar member toward the resonator means; and an air flow regulating valve assembly for regulating air flow through the vacuum plenum.

These and other aspects of the present invention will become apparent from the following description in conjunction with the accompanying drawings, in which.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawings.

Figure 4:
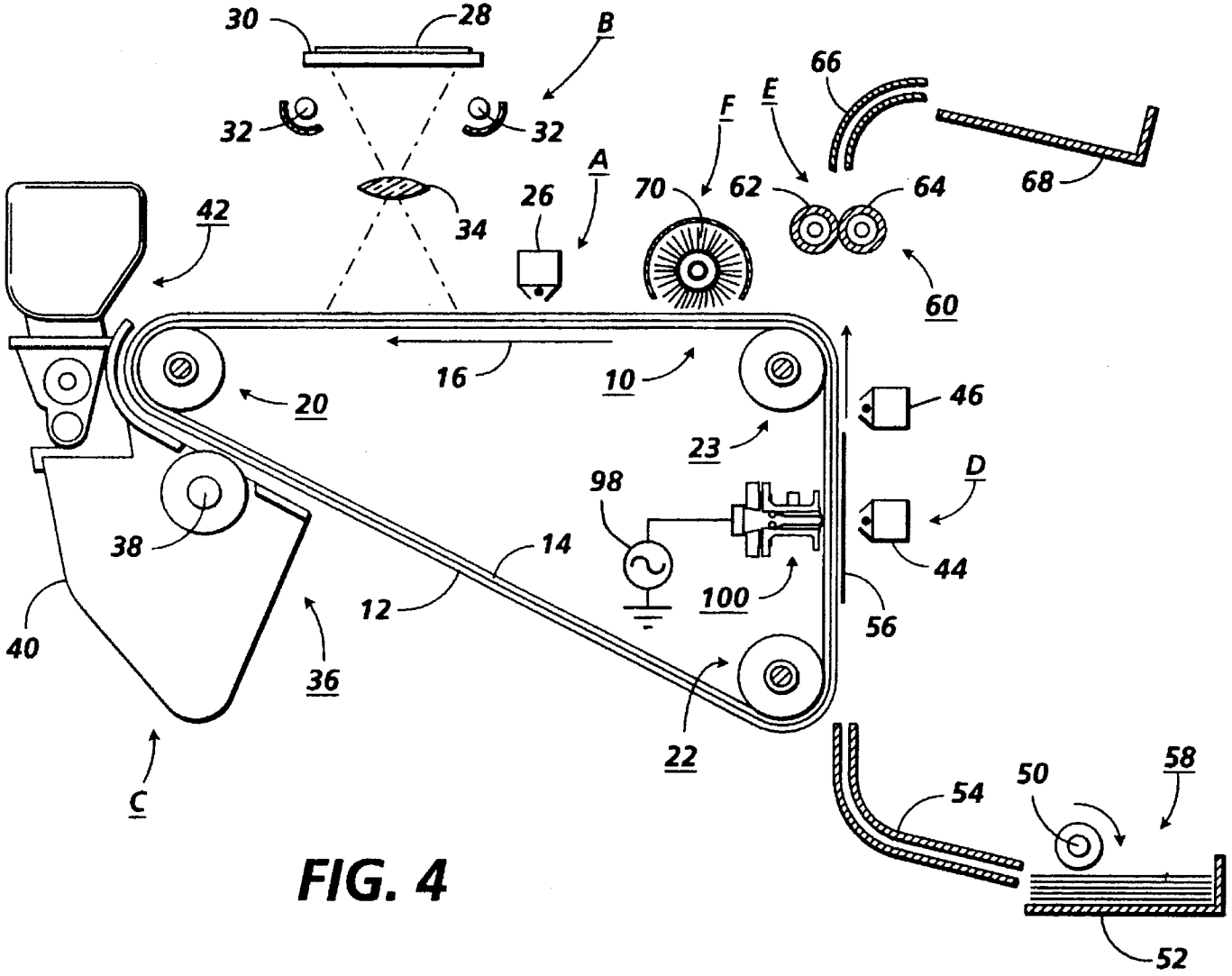
FIG. 4 is a schematic side view of an exemplary electrophotographic reproducing machine including an illustrative embodiment of a transfer station including the vacuum plenum arrangement shown in FIG. 1.

For a general understanding of an exemplary electrostatographic printing machine incorporating the features of the present invention, a schematic depiction of the various processing stations, and the machine components thereof, is provided in FIG. 4. Although the vacuum plenum arrangement of the present invention is particularly well adapted for use with a transfer subsystem in an automatic electrophotographic reproducing machine as shown in FIG. 4, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, and/or in which contact between a vibratory member and an adjacent planar is enhanced, such as a development or cleaning subsystem, for example. It will be further appreciated that the present invention is not necessarily limited to the particular embodiment or embodiments shown and described herein.

Moving now to a description of FIG. 4, prior to discussing the specific features of the present invention in detail, the exemplary electrophotographic reproducing apparatus employs a belt 10 including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a single developer roll 38 disposed in developer housing 40. In the developer housing 40, toner particles are mixed with carrier beads, generating an electrostatic charge therebetween which causes the toner particles to cling to the carrier beads to form developing material. The magnetic developer roll 38 is rotated in the developer housing 40 to attract the developing material therein, forming a "brush" comprising carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface for advancing the developed image to transfer station D. At transfer station D, a sheet of support material 56, such as paper or some other copy substrate, is moved into contact with the developed toner image via sheet feeding apparatus 58 and chute 54 for placing the sheet 56 into synchronous contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a timed sequence for transfer thereto at transfer station D.

In the illustrated embodiment, a corona generating device 44 charges the support material 56 to the proper potential so that the toner image is attracted from the surface of photoreceptor belt 10 to the sheet 56 while the copy sheet 56 is also electrostatically tacked to photoreceptor belt 10. In accordance with the present invention, the transfer station D also includes a relatively high frequency resonator 100, which may be of the acoustic or ultrasonic type, driven by an AC source 98, arranged in vibratory relationship with the back side of belt 10 at a position corresponding to the location of transfer corona generator 44. The resonator 100 applies vibratory energy to the belt 10 for agitating the toner developed in imagewise configuration thereon to provide mechanical release of the toner particles from the surface of the belt 10. Such vibratory energy enhances toner transfer by releasing the attractive forces between the toner particles and the belt 10. Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems are described in U.S. Pat. Nos. 4,987,456; 5,016,055; 5,081,500; and 5,357,324, among other commonly assigned patents, these cited patents being incorporated in their entirety by reference into the present application for patent. Further details of acoustically assisted xerographic toner transfer can also be found in The Society for Imaging Science and Technology (IS&T) Final Program and Proceedings, 8th International Congress on Advances in Non-Impact Printing Technologies, Oct. 25–30, 1992 in an article entitled "Acoustically Assisted Xerographic Toner Transfer", by Crowley, et al. The contents of this paper are also incorporated by reference herein. The novel features of the present invention are directed to the vibratory energy assisted transfer system and will be described in detail herein.

After transfer, a corona generator 46 charges the copy sheet 56 with an opposite polarity to release the copy sheet from belt 10, whereupon the sheet 56 is stripped from belt 10. The support material 56 is subsequently separated from the belt 10 and transported to a fusing station E. It will be understood by those of skill in the art, that the support substrate may also be an intermediate surface or member, which carries the toner image to a subsequent transfer station for transfer to a final support surface. These types of surfaces are also charge retentive in nature. Further, while belt type members are described herein, it will be recognized that other substantially non-rigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support substrate 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator of the type described herein and arranged in a manner similar to resonator 100 for aiding in the removal of toner particles from belt 10.

The foregoing description should be sufficient for the purposes of the present application for patent to illustrate the general operation of an electrophotographic reproducing apparatus incorporating the features of the present invention. As described, the electrophotographic reproducing apparatus may take the form of any of several well known devices or systems. Variations of specific electrostatographic processing subsystems or processes may be expected without affecting the operation of the present invention.

With particular reference to the principle of enhanced toner release as provided by the vibratory energy assisted transfer system described hereinabove and in the art cited in conjunction therewith, a relatively high frequency resonator 100, which may include a piezoelectric device, driven by an A.C. source 98, is generally operated at a frequency between 20 kHz and 200 kHz and typically at approximately 60 kHz. The resonator 100 is arranged in contact with the non-image side of belt 10, so as to be in vibrating relationship therewith, at a position closely in line with transfer station D. Vibration of belt 10 agitates toner developed in imagewise configuration on belt 10 for inducing mechanical release of the toner from the surface of belt 10, allowing more efficient electrostatic attraction of the toner to a sheet during the transfer step. In a preferred arrangement, the resonator 100 is configured such that the vibrating surface thereof is parallel to belt 10 and transverse to the direction of belt movement 16, with a length approximately co-extensive with the belt width or at least having an active resonating area corresponding to the width of the image on the belt 10. The belt 10, described herein, typically has the characteristic of being non-rigid, or somewhat flexible, to the extent that it can be effected by the vibrating motion of the resonator 100.

Figure 1:
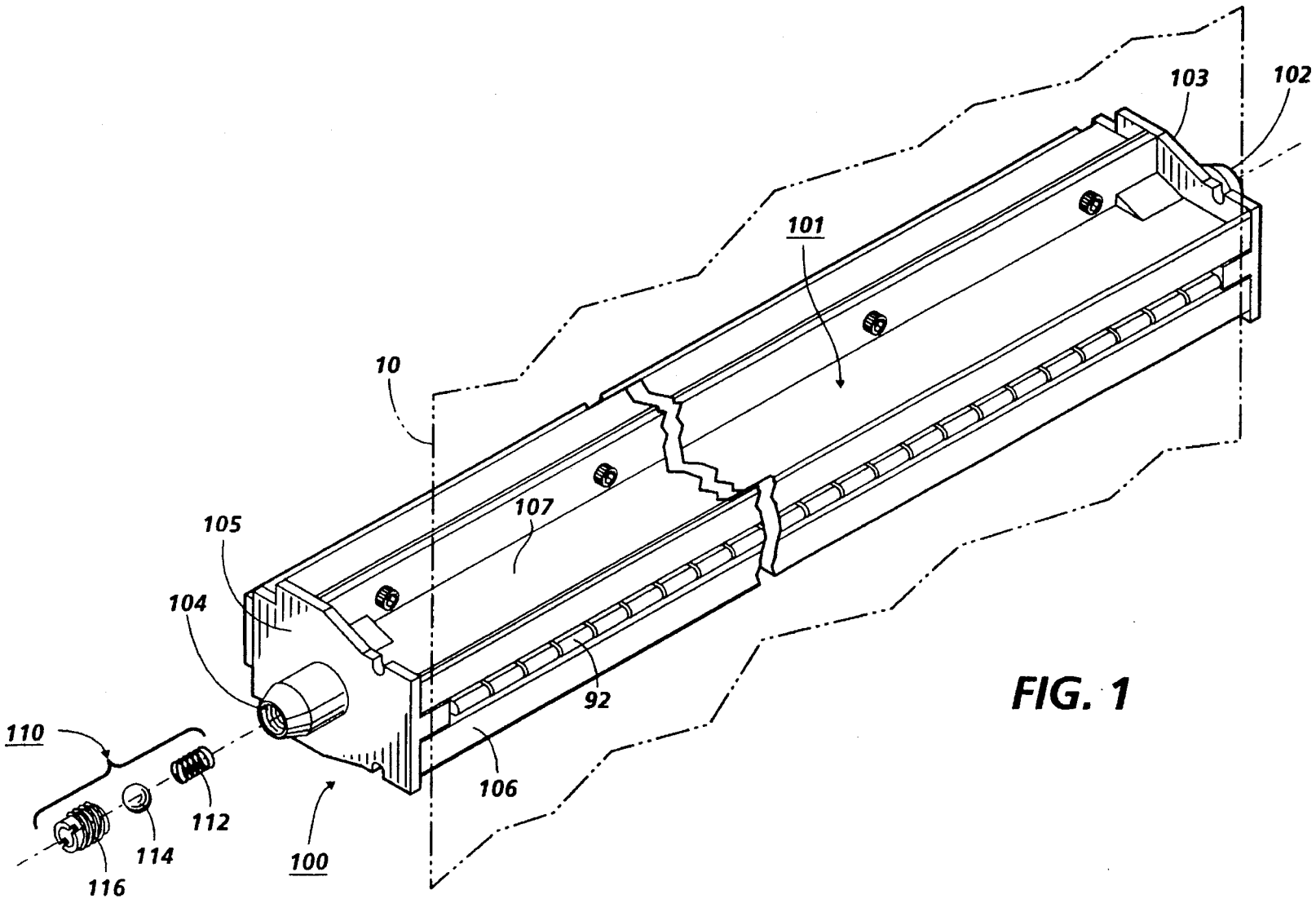
FIG. 1 is a perspective view of a vacuum plenum arrangement incorporating an integral air pressure regulating valve in accordance with the present invention.

Referring now to FIG. 1, the resonator 100 is configured in association with a vacuum plenum arrangement 101, coupled to a vacuum source (not shown) via a vacuum supply port 102 located in end cap 103. This vacuum plenum arrangement provides negative air pressure along the interface between the resonator 100 and the belt 10 for inducing positive contact engagement therebetween by drawing the photoreceptor 10 toward the resonator 100, whereby the resonator 100 may or may not penetrate the normal plane of the photoreceptor 10 for transmitting vibratory energy to photoreceptor 10 in a manner similar to that disclosed in previously cited U.S. Pat. No. 4,987,456. The vacuum plenum arrangement also includes a vacuum regulator port 104 for housing an air pressure regulating valve 110 in end cap 105. The air pressure regulator 110 is made integral with the vacuum plenum arrangement via end cap 105, positioned opposite vacuum supply port 102 in end cap 103. The integral air pressure regulator 110 advantageously provides a means for carefully and accurately adjusting the air flow through the vacuum plenum arrangement such that sufficient negative air pressure is provided to induce contact between the resonator and the photoreceptor while limiting the negative air pressure to prevent excessive vacuum which, in a worst case scenario, could prevent the continued transport motion of the photoreceptive belt 10. The particular features of the vacuum air pressure regulator 110 and the additional benefits provided thereby will discussed in greater detail hereinbelow.

The detailed perspective illustration of FIG. 1 illustrates a particular embodiment for a resonator assembly arranged for being vacuum coupled in contact with the backside of a photoreceptor 10 in the machine configuration shown in FIG. 4. Resonator 100 may comprise a piezoelectric transducer element coupled to a directional horn 92, supported together on a backplate 94 (not shown). Horn 92 includes a base platform which narrows to a horn having a radial tip for radiating vibratory energy against a belt member in contact therewith. Various shapes and structures have been considered for horn 92, as discussed in U.S. Pat. No. 4,987,456. In addition, an adhesive epoxy and conductive mesh layer or other conductive media may be used to bond the assembly elements together without the requirement of a backplate or other mechanical coupling devices, as discussed in detail in commonly assigned U.S. patent application Ser. No. 08/332,152. It will be recognized that the removal of the backplate reduces the tolerances required in construction of the resonator, particularly allowing greater tolerance in the thickness of the piezoelectric element.

Thus, the vacuum plenum 101 encloses directional horn 92 in a generally air tight vacuum environment defined by upstream and downstream longitudinal walls 106 and 107, respectively. The vacuum plenum 101 is sealed at inboard and outboard sides along the marginal edges of the belt 10 (not shown) by means of end cap blocks 103, 105 interlocking mounted to opposite ends of walls 106, 107. In addition, the internal interface between the vacuum plenum 101 and the horn 92 is sealed with an elastomer sealing member (not shown), which also serves to isolate the vibration of the horn body from walls 106 and 107. Walls 106 and 107 are approximately parallel to the body of the horn 92, extending to a common plane and together forming an opening in the vacuum plenum 101 adjacent to the photoreceptor belt 10. A replaceable resonator coupling cover, as disclosed in U.S. Pat. No. 5,357,324, may be mounted in this opening, forming an interface between the horn and the photoreceptor, for reasons as discussed in that patent.

As previously stated, vacuum plenum 101 is coupled to a vacuum or negative air pressure source (not shown), such as a diaphragm pump or a blower, via vacuum supply port 102, in end cap 103. Negative air pressure is applied to the vacuum plenum 101 for inducing air flow through the plenum 101 in a direction from the opening thereof adjacent the photoreceptor belt 10 to supply port 102, such that belt 10 adjacent to the plenum opening is drawn into contact with the resonator assembly, and in particular, with the horn 92 which imparts the vibratory energy of the resonator 100 to belt 10. This arrangement provides positive contact engagement between the resonator 100 and the photoreceptor 10 while maintaining continuity along the region of contact between the resonator 100 and the belt 10.

Figure 2:
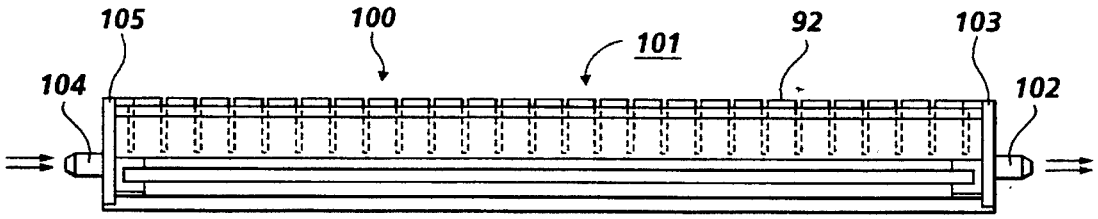
FIG. 2 is an elevational side view of the vacuum plenum arrangement of FIG. 1.
Figure 3:
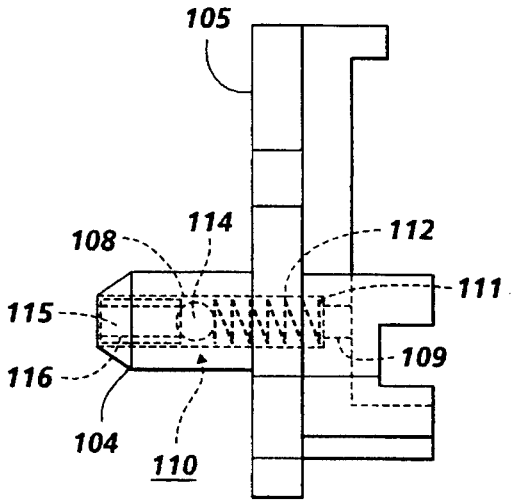
FIG. 3 is an elevational side view of an air pressure regulator in accordance with the present invention.

The present invention provides an air pressure regulating valve for varying and controlling the air flow through the previously described vacuum plenum arrangement. In a preferred embodiment, the air pressure regulating valve, generally identified by reference numeral 110, is incorporated as an integral feature in end cap 105, situated opposite end cap 103 and, more importantly, opposite vacuum supply port 102, relative to the longitudinal axis of the resonator 100. The proximity of the air pressure regulator 110 to the opening in the vacuum plenum adjacent the photoreceptor belt 10 advantageously decreases the response time for air flow regulation within the vacuum plenum 101. As shown in FIGS. 2 and 3, the air pressure regulator valve 110 includes a vacuum regulator port 104 comprising a primary inlet bore 108 aligned with a secondary inlet bore 109 formed in the body of end cap 105 for allowing air to flow into the vacuum plenum through the port 104. The primary inlet bore 108 has a diameter greater than secondary inlet bore 109 forming an interface wall 111 therebetween. The active components of the air regulator 110 include a spring member 112, a ball bearing member 114, and a hollow adjustment screw 116. The spring member 112 is inserted into the primary inlet bore 108, resting against interface wall 111. In addition, ball bearing member 114, having a diameter less than the diameter of the primary inlet bore 108, is inserted within the primary inlet bore 108 resting against the inner diameter of spring member 112. Finally, the hollow adjustment screw 116 is threaded into the primary inlet bore so as to be in abutment with ball bearing 114 in a manner such that the ball bearing is seated against an orifice 115 defined by the hollow adjustment screw, being urged thereagainst by means of the spring member 112. These components operate in conjunction with one another to form a type of spring loaded ball valve as will be described, and as is best shown in FIG. 3 wherein the ball bearing 114 operates as a movable valve member. Air flow through the vacuum regulation port 104 is restricted with the ball bearing in contact with and seated against orifice 115 of hollow adjustment screw 116, while air flow is permitted through the vacuum regulation port 104 with the ball bearing disengaged from the hollow adjustment screw.

As previously described, during operation, a vacuum source coupled to the vacuum plenum 101 is activated to generate negative air pressure within the vacuum plenum 101 such that air flows through the vacuum plenum in a direction from the opening in the vacuum plenum adjacent the photoconductor belt 10 toward vacuum port 102. Air flow into the vacuum plenum through the vacuum regulation port 104 permits regulation of air flow to the vacuum source such that substantially constant negative air pressure is generated along the opening of the vacuum plenum adjacent the photoconductor belt. In a situation where the negative air pressure in the vacuum plenum 101 is relatively low, the ball bearing member 114 will be permitted to rest against the hollow adjustment screw 116 and is actually urged against the orifice 115 thereof by means of spring 112 such that air flow through the vacuum regulation port 104 will be prohibited and air will enter into the vacuum plenum 101 only through the opening therein adjacent the photoconductor 10. In this state, the negative air pressure will build and ultimately draw the photoconductor into contact engagement with the resonator, as desired. Conversely, in the situation where the negative air pressure within the vacuum plenum is relatively high, the ball bearing 114 will be pulled toward the vacuum plenum, thereby compressing the spring member 112 and disengaging with the orifice 115 in the hollow adjustment screw 116. Disengagement of the ball bearing 114 from the hollow adjustment screw 116 permits air to flow through the orifice 115 and through the vacuum regulation port 104 to decrease the negative air pressure within the vacuum plenum 101. During the course of operation, the cycle described hereinabove is conducted on a continuous basis to provide a substantially constant air pressure at the interface between the vacuum plenum and the photoconductive belt 10. Thus, it is noted, that the hollow adjustment screw 116 provides for selective variation of the air flow in that the hollow adjustment screw 116 can be selectively positioned within the primary inlet bore 106, relative to the spring member 112, for adjusting the spring pressure thereof. Thus, if the hollow adjustment screw 116 is adjusted to significantly compress spring member 112, a greater negative air pressure within the vacuum plenum will be required in order to disengage the ball bearing member 114 from the hollow adjustment screw 116 for allowing air to flow through port 104.

The air regulation system of the present invention is designed to dynamically compensate for variations in the vacuum source by providing an air regulator which is permitted to oscillate at an inherent modulation frequency relative to the vacuum source so as to minimize the adverse affects of pressure variation at the belt interface. In addition, the integral air pressure regulator of the present invention effectively positions the regulator within close proximity to the point of air flow modulation, thereby providing minimal response time and pressure changes. This system minimizes motion quality errors by significantly reducing pressure variation at the belt interface while providing an extremely robust system which accounts for pressure variations which are inherent to vacuum source systems. Specifically, the vacuum pressure recovery time is shortened, as the photoreceptor belt interacts with the vacuum plenum and the resonator.

Using the vacuum coupled resonator arrangement described above, application of high frequency acoustic or ultrasonic energy to belt 10 is induced within the area of application of the transfer field, and preferably within the area adjacent transfer corotron 44. While transfer efficiency improvements appear to be obtained with the application of high frequency acoustic or ultrasonic energy throughout the transfer field, it appears that it is desirable for the resonator 100 to deliver vibratory energy in a limited region approximately opposite the centerline of the transfer corotron 44. Thus, it is preferable to restrict the application of vibratory energy to a defined region so that vibration does not occur outside the transfer field. Notably, it has been found that application of vibratory energy outside the transfer field tends to cause greater electromechanical adherence of toner to the belt surface, creating a problem for subsequent transfer or cleaning. It is noted that the air pressure regulator 110 of the present invention also tends to dampen the vibration of the belt 10 outside of the transfer region in which vibration is desired, resulting in a focused area of agitation whereby the vibratory energy imparted to the belt 10 does not disturb the dynamics of the sheet tacking or detacking process, or disturb the image prior to the optimal transfer region or induce back transfer at a post transfer region.

With reference again to FIG. 4, it will no doubt be appreciated that the inventive resonator/air pressure regulator arrangement may find application as a means for improving uniformity of application of vibratory energy to a flexible member for the release of toner therefrom which may be utilized in various ways in electrophotographic applications. One example of utilization may be found in causing release of toner from a toner bearing donor belt, arranged in development position with respect to a latent image. Enhanced development may be noted, with mechanical release of toner from a donor belt surface and electrostatic attraction of the toner to the image. The resonator of the present invention has equal application in the cleaning station of a typical electrophotographic device with little variation. Accordingly, a resonator assembly in accordance with the present invention may be arranged in close relationship to the cleaning station F, for the mechanical release of toner from the surface prior to cleaning. Additionally, it will be understood by those of skill in the art that improvement in pre-clean treatment may occur with application of vibratory energy simultaneously with pre-clean charge leveling.

In review, the electrophotographic printing machine of the present invention includes a vibratory energy producing resonator for generating vibratory energy to reduce adhesion of the toner image to an image bearing member. Also provided, is a vacuum assembly for generating negative air pressure to urge or draw the image bearing member toward the vibratory energy producing resonator, wherein the vacuum assembly includes an air flow regulator for regulating the negative air pressure at the interface between the resonator and the image bearing member. A specific embodiment of an air regulator which may be advantageously utilized in accordance with the present invention is described. The integral air regulator of the present invention provides a simple, and inexpensive system for providing constant contact forces between the photoreceptor belt and the resonator and also tends to optimize the region in which vibratory energy is delivered to the image bearing member by dampening the vibration of the belt outside of the transfer region, resulting in a focused area of vibration. It will be understood that, although a specific embodiment of an integral air regulator system is disclosed and described in detail, various air regulating systems which are known in the art may also be incorporated into the present invention such that the present invention is not to be limited by the specific embodiment described herein.

It is, therefore, evident that there has been provided, in accordance with the present invention, an electrophotographic printing apparatus and, in particular, a vacuum coupling arrangement for applying vibratory energy to a photoreceptive belt, that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, the present application for patent is intended to embrace all such alternatives, modifications, and variations as are within the broad scope and spirit of the appended claims.

I claim:

1. A system for enhancing transfer of toner from an image bearing member, comprising:

means for applying vibratory energy to the image bearing member to facilitate toner release therefrom;

vacuum means for generating negative air pressure to draw the image bearing member toward said vibratory energy applying means; and air flow regulating means for regulating the negative air pressure at an interface between said vibratory energy applying means and the image bearing member.

2. The system of claim 1, wherein said vacuum means includes:

a vacuum source; and a plenum partially enclosing said vibratory energy applying means and coupled to said vacuum source, said vacuum plenum defining a vacuum plenum opening adjacent the image bearing member.

3. The system of claim 2, wherein said air flow regulating means includes:

a vacuum regulator port defining an inlet bore for allowing air to flow into said vacuum plenum;

a spring member for being inserted into the inlet bore;

a ball bearing member for being further inserted into the inlet bore adjacent said spring member; and a hollow adjustment screw for being threaded into said vacuum regulator port so as to compress said spring member by pressing said ball bearing member thereagainst.

4. The system of claim 2, wherein said hollow adjustment screw defines an orifice for coupling the inlet bore to an ambient air environment, such that air flow through said vacuum regulator port is restricted with said ball bearing member sealed against the orifice and air flow is permitted through said vacuum regulator port with said ball bearing member disengaged from the orifice.

5. The system of claim 2, wherein said vacuum plenum includes:

a pair of wall members having said vibratory energy applying means interposed therebetween, said wall members extending to a substantially common plane for defining the vacuum plenum opening; and a pair of end caps, each end cap being interlockingly mounted to opposite ends of said pair of wall members for forming a generally air tight environment within said vacuum plenum.

6. The system of claim 5, wherein said vibratory energy applying means includes a horn member extending substantially to said plane defining the vacuum plenum opening for directing vibratory energy to the image bearing member.

7. The system of claim 5, wherein at least one of said end cap members includes a vacuum port for coupling said vacuum plenum to said vacuum source.

8. The system of claim 5, wherein at least one of said end cap members includes said air flow regulating means integral thereto.

9. The system of claim 1, wherein said vibratory energy applying means includes a piezoelectric transducer.

10. The system of claim 1, further including means for electrostatically attracting the toner image from the image bearing member.

11. An electrostatographic printing machine of the type in which a developed toner image is transferred from an image bearing member to a support substrate via a transfer system, including a system for enhancing release of toner from the image bearing member, comprising:

a resonator for applying vibratory energy to the image bearing member to facilitate toner release therefrom;

a vacuum apparatus for urging the image bearing member toward said coupling cover; and air flow regulating means coupled to said vacuum apparatus for regulating air pressure at an interface between said resonator and the image bearing member.

12. The electrostatographic printing machine of claim 11, wherein said vacuum apparatus includes:

a vacuum source; and a vacuum plenum partially enclosing said resonator and coupled to said vacuum apparatus, said vacuum plenum defining a vacuum plenum opening adjacent the image bearing member, wherein said vacuum source provides sufficient negative air pressure at said vacuum plenum opening to draw the image bearing member toward said resonator.

13. The electrostatographic printing machine of claim 12, wherein said air flow regulating means includes:

a vacuum regulator port defining an inlet bore for coupling the vacuum plenum to an ambient air environment to allow air to flow into said vacuum plenum;

a spring member for being inserted into the inlet bore;

a ball bearing member for being further inserted into the inlet bore adjacent said spring member; and a hollow adjustment screw for being threaded into said vacuum regulator port so as to compress said spring member by pressing said ball bearing member thereagainst.

14. The electrostatographic printing machine of claim 13, wherein said hollow adjustment screw defines an orifice for coupling the inlet bore to an ambient air environment, such that air flow through said vacuum regulator port is restricted with said ball bearing member seated against the orifice and air flow is permitted through said vacuum regulator port with said ball bearing member disengaged from the orifice.

15. The electrostatographic printing machine of claim 12, wherein said vacuum plenum includes:

a pair of wall members having said vibratory energy applying means interposed therebetween, said wall members extending to a substantially common plane for defining the vacuum plenum opening; and a pair of end caps, each end cap being interlockingly mounted to opposite ends of said pair of wall members for forming a generally air tight environment within said vacuum plenum.

16. The electrostatographic printing machine system of claim 15, wherein said vibratory energy applying means includes a horn member extending substantially to said plane defining the vacuum plenum opening for directing vibratory energy to the image bearing member.

17. The electrostatographic printing machine system of claim 15, wherein at least one of said end cap members includes a vacuum port for coupling said vacuum plenum to said vacuum source.

18. The electrostatographic printing machine system of claim 15, wherein at least one of said end cap members includes said air flow regulating means integral thereto.

19. The electrostatographic printing machine system of claim 11, wherein said vibratory energy applying means includes a piezoelectric transducer.

20. The electrostatographic printing machine of claim 11, further including a corona generating device for electrostatically attracting the developed toner image from the image bearing member, said resonator being positioned in alignment with said corona generating device with said image bearing member being interposed therebetween.

21. An apparatus for applying vibratory motion to a flexible planar member, comprising:

resonator means for applying vibratory energy to the flexible planar member;

vacuum means, including a vacuum plenum substantially enclosing said resonator means and defining an opening adjacent the flexible planar member, wherein said vacuum means provides sufficient air flow through said vacuum plenum opening to draw the flexible planar member toward said resonator means; and an air flow regulating valve assembly for regulating air flow through said vacuum plenum.

22. The apparatus of claim 21, wherein said air flow regulating means includes:

a vacuum regulator port defining an inlet bore for allowing air to flow into said vacuum plenum;

a spring member for being inserted into the inlet bore;

a ball bearing member for being further inserted into the inlet bore adjacent said spring member; and a hollow adjustment screw for being threaded into said vacuum regulator port so as to compress said spring member by pressing said ball bearing member thereagainst.

23. The apparatus of claim 22, wherein said hollow adjustment screw defines an orifice for coupling the inlet bore to an ambient air environment, such that air flow through said vacuum regulator port is restricted with said ball bearing member sealed against the orifice and air flow is permitted through said vacuum regulator port with said ball bearing member disengaged from the orifice.

* * * * *